US005766376A

United States Patent [19]

Hasegawa et al.

[11] Patent Number: 5,766,376

[45] Date of Patent: Jun. 16, 1998

[54] HIGH-STRENGTH FERRITIC HEAT-RESISTANT STEEL AND METHOD OF PRODUCING THE SAME

[75] Inventors: Yasushi Hasegawa; Hisashi Naoi, both of Chiba; Takashi Sato; Kohji Tamura, both of Hiroshima, all of Japan; Toshio Fujita, 144, Mukougaoka 1-chome, Bunkyo-ku, Tokyo, Japan

[73] Assignees: Nippon Steel Corporation; Babcock-Hitachi Kabushiki Kaisha; Toshio Fujita, all of Tokyo, Japan

[21] Appl. No.: 669,321

[22] PCT Filed: Nov. 2, 1995

[86] PCT No.: PCT/JP95/02247

§ 371 Date: Jul. 22, 1996

§ 102(e) Date: Jul. 22, 1996

[87] PCT Pub. No.: WO96/14443

PCT Pub. Date: May 17, 1996

[30] Foreign Application Priority Data

Nov. 4, 1994 [JP] Japan ..... 6-271623

[51] Int. Cl.[6] ..... C22C 38/22; C22D 8/00; C22D 9/00

[52] U.S. Cl. ..... 148/328; 148/334; 148/547

[58] Field of Search ..... 148/328, 334, 148/547

[56] References Cited

U.S. PATENT DOCUMENTS 5,211,909 5/1993 Iseda et al. ..... 420/106

FOREIGN PATENT DOCUMENTS

| | | |
|---|---|---|
| 5125204 | 7/1976 | Japan . |
| 2310340 | 12/1990 | Japan . |
| 3211251 | 9/1991 | Japan . |
| 543986 | 2/1993 | Japan . |
| 5186848 | 7/1993 | Japan . |
| 621321 | 3/1994 | Japan . |

*Primary Examiner*—Deborah Yee
*Attorney, Agent, or Firm*—Kenyon & Kenyon

[57] ABSTRACT

This invention provides a ferritic heat-resistant steel having excellent HAZ softening resistance characteristics and exhibiting a high creep strength up to a high temperature of not lower than 500° C., and a method of producing such a steel, the steel comprising in terms of mass %, 0.01 to 0.30% of C, 0.02 to 0.80% of Si, 0.20 to 1.50% of Mn, 0.50 to 5.00% of Cr, 0.01 to 1.50% of Mo, 0.01 to 3.50% of W, 0.02 to 1.00% of V, 0.01 to 0.50% of Nb, 0.001 to 0.06% of N, one or both of 0.001 to 0.8% of Ti and 0.001 to 0.8% of Zr, wherein a value (Ti+Zr) in (Cr, Fe, Ti, Zr) of a $M_{23}C_6$ type carbide in the steel is 5 to 65%, and the present invention provides a method of producing the same.

4 Claims, 11 Drawing Sheets

HIGH-STRENGTH FERRITIC HEAT-RESISTANT STEEL AND METHOD OF PRODUCING THE SAME

TECHNICAL FIELD

This invention relates to a ferritic heat-resistant steel. More particularly, the present invention relates to a ferritic heat-resistant steel which is used in a high temperature and high pressure environment, has high creep rupture strength and has excellent HAZ softening resistance characteristics. The present invention particularly relates to an improvement in the strength and the toughness by controlling the change resulting from thermal influences on constituent elements of carbides.

BACKGROUND ART

A temperature and a pressure in the operation condition of thermal power boilers have become remarkably higher in recent years, and some boilers have been operated at 566° C. and 316 bar. An operating condition of up to 649° C. and 352 bar is expected in future, and extremely severe conditions will be imposed on the materials used.

Heat-resistant steels used for thermal power plants are exposed to different environments depending on the positions at which they are used. Austenitic materials having high temperature corrosion resistance and particularly high strength or ferritic materials containing 9 to 12% of Cr have been widely used for portions having a high metal temperature, such as so-called "superheater pipes" and "reheater pipes".

Recently, novel heat-resistant steels to which W is added afresh so as to contribute to the improvement in the high temperature strength have been developed and put into practical application, and have made a great contribution to the accomplishment of high-efficiency of electric power plants. For example, Japanese Unexamined Patent Publications (Kokai) No. 63-89644, No. 61-231139, No. 62-297435, and so forth, disclose a ferritic heat-resistant steel capable of drastically higher creep rupture strength in comparison with Mo-containing ferritic heat-resistant steels according to the prior art, by using W as a solid solution reinforcement element. The structure of these steels is in most cases a tempered martensite mono-phase. Due to the combination of the superiorities of ferritic steels having excellent steam oxidation resistance characteristics and high strength characteristics, they are expected as the materials of the next generation to be used in a high temperature and a high pressure environment.

Because a higher pressure of the thermal power plants has been accomplished, the operating conditions for the portions for which the operating temperatures have been relatively low so far, such as wall pipes of fire furnaces, heat-exchangers, steam generators, main steam pipes, have become also severer, and low Cr content ferritic heat-resistant steels such as so-called "1Cr steel", "1.25Cr steel", "2.25Cr steel", etc, that are stipulated by the industrial standards, cannot cope with such an operation condition.

To cope with such a trend, a large number of steels which improve the high temperature strength by positively adding W or Mo to these low strength materials have been proposed. In other words, Japanese Unexamined Patent Publication (Kokai) Nos. 63-18038 and 4-268040 and Japanese Examined Patent Publications (Kokoku) No. 6-2926 and No. 6-2927 propose a steel which improves the high temperature strength of 1 to 3%Cr steel by adding W as a main reinforcement element. Any of these steels have higher high-temperature strength than the conventional low Cr steels.

On the other hand, the ferritic heat-resistant steels utilize the high strength of ferritic structures such as the martensite structure, the bainite structure, etc, or their tempered structures, that contain large quantities of dislocation generated as a result of the supercooling phenomenon exhibited by the phase transformation from the austenite mono-phase region to the ferrite plus carbide precipitation phase occurring during the cooling process of the heat-treatment. Therefore, when this structure receives the thermal hysteresis of being again re-heated to the austenite mono-phase region such as when it is affected by welding heat, the high density dislocation is again released, so that a local drop in strength is likely to occur at the welding heat affected zone. Particularly among those portions which are re-heated to a temperature higher than the ferrite-austenite transformation point, those portions which are heated to a temperature near the transformation point, such as about 800° to about 900° C. in the case of the 2.25%Cr steel, for example, and are again cooled within a short time, become a fine grain structure because the non-diffusion transformation such as the martensite transformation or the bainite transformation occurs again before the austenite crystal grains grow sufficiently. Moreover, a $M_{23}C_6$ type carbide which is the principal factor for improving the material strength by precipitation hardening is mostly converted again to the solid solution when heated to a temperature above the transformation point, even for a short time, due to a high C and N solid solution limit of the gamma (γ) region. The $M_{23}C_6$ type carbide mainly coarsely precipitates on the γ grain boundaries or on extremely coarse insoluble carbides.

The phenomenon in which the creep strength locally drops due to composite operation of these mechanisms will be hereinafter referred to as "HAZ softening" for convenience.

The inventors of the present invention have conducted intensive and detail studies of this softening region, and have found out that the drop of the strength mainly results from the change of the constituent elements of the $M_{23}C_6$ type carbide. As a result of further studies, the present inventors have found out that a large amount of Mo or W, which is an indispensable element particularly for the solid solution hardening of the high strength martensitic heat-resistant steels, undergoes solid solution into the constituent metal element M of $M_{23}C_6$, and precipitates on the grain boundary of the fine grain structure, and that, as a result, a Mo or W-denuded phase is generated in the proximity of the austenite grain boundary and results in the local drop of the creep strength.

Accordingly, the drop in the creep strength due to the influences of welding heat is critical for the heat-resistant steels, and the prior art technology such as heat-treatment or optimization of the welding process cannot fundamentally solve this problem. Moreover, the application of a measure for converting again the weld portion to the complete austenite, which was believed to be the only solution method, is not feasible in consideration of the construction process of a power generation plant. Therefore, the conventional martensite steels or ferrite steels unavoidably involve the "HAZ softening" phenomenon.

Therefore, though the novel low Cr ferritic heat-resistant steels containing W and Mo have a high base metal strength, they exhibit a local drop in strength as high as 30% at the portions affected by welding heat in comparison with the base metal, and are therefore regarded as materials having a small improvement effect of the strength according to the prior art.

DISCLOSURE OF THE INVENTION

In order to avoid the problems of the prior art steels described above, that is, decomposition of the $M_{23}C_6$ carbide and the formation of the local softening region of a welding heat affected zone resulting from coarsening of grains, and to make it possible to control the composition of the $M_{23}C_6$ type carbide and the precipitation size, the present invention provides a novel ferritic heat-resistant steel of a W and Mo addition type and a production method thereof. The present invention is directed particularly to provide a high strength ferritic heat-resistant steel which does not generate a "HAZ softening region" by containing one, or both, of Ti and Zr and by combining specific production processes.

The present invention is completed on the basis of the finding described above, and the gist of the present invention resides in the following points.

A ferritic heat-resistant steel having excellent HAZ softening resistance characteristics, which contains, in terms of mass %:

| | | | |
|---|---|---|---|
| C: | 0.01 to 0.30%, | Si: | 0.02 to 0.80%, |
| Mn: | 0.20 to 1.50%, | Cr: | 0.50 to less than 5.00%, |
| Mo: | 0.01 to 1.50%, | W: | 0.01 to 3.50%, |
| V: | 0.02 to 1.00%, | Nb: | 0.01 to 0.50%, |
| N: | 0.001 to 0.06%, | | |

one or both of the following two members, either alone or in combination:

| | | | |
|---|---|---|---|
| Ti: | 0.001 to 0.8%, and | Zr: | 0.001 to 0.8%; |
| P: | not more than 0.030%, | | |
| S: | not more than 0.010%, | | |
| O: | not more than 0.020%, | | |

one or both of the following two members:

| | | | |
|---|---|---|---|
| Co: | 0.2 to 5.0%, and | Ni: | 0.2 to 5.0%, |

and the balance consisting of Fe and unavoidable impurities;

wherein a $M_{23}C_6$ type carbide is allowed to precipitate with Ti and Zr carbide as the nuclei thereof, and is thereafter converted to a carbide consisting of $(Cr, Fe, Ti, Zr)_{23}C_6$ as the principal component thereof by mutual solid solution, and a (Ti %+Zr %) value in (Cr, Fe, Ti, Zr) is 5 to 65. The gist of the present invention resides also in a production method of a ferritic heat-resistant steel having excellent HAZ softening resistance characteristics which comprises adding Ti and Zr within 10 minutes immediately before tapping so that the value of (Ti %+Zr %) in (Cr, Fe, Ti, Zr) described above becomes 5 to 65, temporarily stopping cooling after solid solution heat-treatment at 880° to 930° C., and holding the steel at the same temperature for 5 to 60 minutes.

BEST MODE FOR CARRYING OUT THE INVENTION

Figure 1:
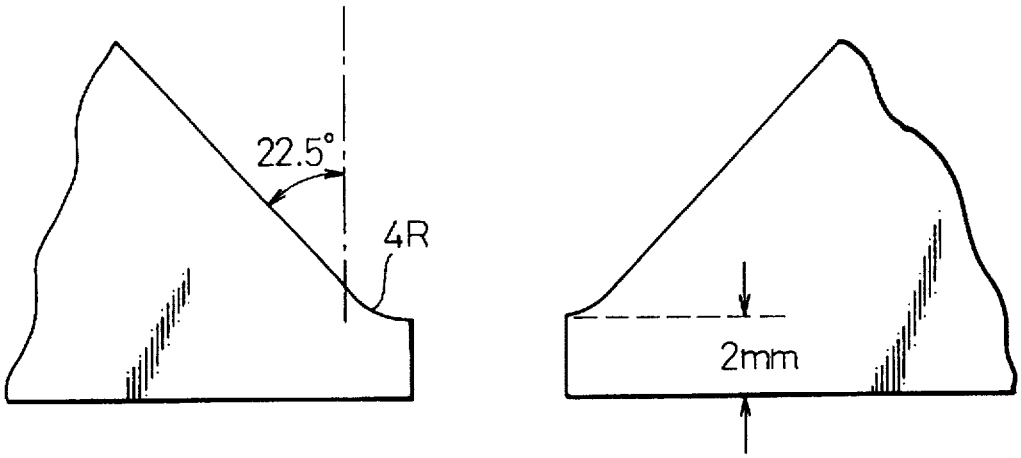
FIG. 1 shows a butt groove shape of a weld joint.

Hereinafter, the present invention will be explained in detail.

To begin with, the reason why the range of each component is limited as described above will be explained.

C is necessary for ensuring the strength. If its amount is less than 0.01%, however, the strength cannot be secured sufficiently, and if it exceeds 0.30%, a welding heat affected portion becomes remarkably hardened and results in low temperature crack at the time of welding. Therefore, the C content is limited to the range of 0.01 to 0.30%.

Si is an important element for securing the oxidation resistance and also as a deoxidizing agent. If its amount is less than 0.02%, the effect of Si is not sufficient and if it exceeds 0.80%, the creep strength will drop. Therefore, the Si content is limited to the range of 0.02 to 0.80%.

Mn is a necessary component not only for deoxidation but also for ensuring the strength. To obtain sufficient effects, at least 0.20% of Mn must be added. If its amount exceeds 1.50%, however, the creep strength drops in some cases. Therefore, the Mn content is limited to the range of 0.20 to 1.50%.

Cr is an indispensable element for securing the oxidation resistance and at the same time, contributes to the improvement of the creep strength as it combines with C and finely precipitates inside the base metal matrix in the forms such as $Cr_{23}C_6$, $Cr_7C_3$, etc. The lower limit is set to 0.5% from the aspect of the oxidation resistance, and the upper limit is set to less than 5.0% in order to secure sufficient toughness at room temperature.

W is an element which remarkably improves the creep strength by solid solution strengthening, and remarkably improves the creep strength for a long time particularly at a high temperature of above 500° C. If it is added in an amount exceeding 3.5%, however, large amounts of W precipitate as intermetallic compounds with the grain boundary as the center, and remarkably lower the toughness of the base metal and the creep strength. Therefore, the upper limit is set to 3.5%. If its amount is less than 0.01%, the effect of solid solution strengthening is not sufficient. Therefore, the lower limit is set to 0.01%.

Mo, too, is an element which improves the high temperature strength by solid solution strengthening. If its amount is less than 0.01%, however, its effect is not sufficient and if it exceeds 1.00%, large quantities of $Mo_2C$ type carbides or $Fe_2Mo$ type intermetallic compounds precipitate, and when Mo is added simultaneously with W, the toughness of the base metal is remarkably lowered in some cases. Therefore, the upper limit is set to 1.00%.

V is an element which remarkably improves the high temperature creep rupture strength of the steel both when it precipitates as a precipitate and when it undergoes solid solution in the matrix simultaneously with W. If the amount of V is less than 0.02% in the present invention, precipitation strengthening by the V precipitates is not sufficient and if it exceeds 1.00%, on the contrary, clusters of the V type carbides or carbonitrides are formed and invite the drop of the toughness. Therefore, V content is limited to the range of 0.02 to 1.00%.

Nb improves the high temperature strength as it precipitates in the form of MX type carbides or carbonitrides, and also contributes to solid solution strengthening. If its amount is less than 0.01%, the effect of addition cannot be recognized, and if it exceeds 0.50%, Nb precipitates as coarse particles and lowers the toughness. Therefore, its content is limited to the range of 0.01 to 0.50%.

N dissolves in the matrix as the solid solution, or precipitates nitrides or carbonitrides, mainly as the forms of VN and NbN or respective carbonitrides, and contributes to solid solution strengthening and precipitation hardening. If its amount is less than 0.001%, N hardly contributes to strengthening and in consideration of the upper limit that can be added to the molten steel in accordance with the addition amount of Cr whose upper limit is 5%, the upper limit is set to 0.06%.

The addition of Ti and Zr constitutes the very gist of the present invention, and addition of these elements makes it possible to avoid "HAZ softening" in combination with the novel and specific production steps. In the component system of the present steel, Ti and Zr have extremely high affinity with C, undergo solid solution in M as the constituent metal elements of $M_{23}C_6$, and raise the decomposition temperature (re-solid solution point) of $M_{23}C_6$. Accordingly, they are effective for preventing coarsening of $M_{23}C_6$ in the "HAZ softening" region. Moreover, they prevent solid solution of W and Mo into $M_{23}C_6$ and hence, do not form the denuded phase of W and Mo around the precipitates. These elements may be added either alone or both in combination, and their effect can be obtained from the lower limit of 0.001%. Since the addition of these elements in an amount exceeding 0.8% as a single substance forms coarse MX type carbides and deteriorates the toughness, their contents are limited to the range of 0.001 to 0.8%.

P, S and O are impurities in the steel of the present invention. In connection with the effects of the present invention, P and S lower the strength, while O precipitates as oxides and lowers the toughness. Therefore, their upper limit values are set to 0.03%, 0.01% and 0.02%, respectively.

The components described above are the fundamental components of the present invention, but 0.2 to 5.0% of one, or both, of Ni and Co may be added depending on the intended application.

Both of Ni and Co are strong austenite stabilization elements. Particularly when large amounts of ferrite stabilization elements, that is, Cr, W, Mo, Ti, Zr, Si, etc. are added, Ni and Co are necessary for obtaining ferritic structures such as bainite and martensite or their tempered structures and are useful for such a purpose. At the same time, Ni is effective for improving the toughness and Co, for improving the strength. If their amount is less than 0.2%, the effect is not sufficient and if it exceeds 5.0%, precipitation of coarse intermetallic compounds is unavoidable. Therefore, their contents are limited to the range of 0.2 to 5.0%.

Incidentally, the present invention provides a high strength ferritic heat-resistant steel having excellent HAZ softening resistance characteristics. Therefore, a production method, and heat-treatment, may be suitably employed for the steel of the present invention in accordance with the object of use of the steel, and the effects of the present invention are not at all impeded by them.

However, in order to appropriately exploit the addition effect of Ti and Zr described above, a (Ti %+Zr %) value in the metal components M of the $M_{23}C_6$ type carbide existing in the welding heat affected zone, that is, in (Cr, Fe, Ti, Zr), must be from 5 to 65. For this purpose, in order to allow Ti and Zr to precipitate in the form of suitable carbides in the steel, they are added within ten minutes immediately before tapping, and it is necessary to control the precipitation form by temporarily stopping cooling after solid solution heat-treatment at a temperature of 880° to 930° C. and holding the steel at the same temperature for 5 to 60 minutes, and to utilize (Cr, Fe, Ti, Zr) precipitating at the time of subsequent tempering treatment as the precipitation nuclei of $M_{23}C_6$ as the principal component of M. Only when the production process described above is applied, does the addition effect of Ti and Zr exhibit suitably, and the object of the present invention can be thereby accomplished. In other words, even when the materials containing the chemical components which are adjusted to the range of the present invention are merely employed for the conventional steel production process, the effects contemplated by the present invention cannot be obtained. In other words, the (Ti %+Zr %) value in the metal components M of the $M_{23}C_6$ type carbide existing in the welding heat affected zone, that is, in (Cr, Fe, Ti, Zr), cannot be controlled to 5 to 65 by such a process.

The production process and the composition range of the carbide described above are determined by the following experiments.

Steels within the range of the present invention with the exception of Ti and Zr were molten in a VIM (vacuum induction heating furnace) and an EF (electric furnace) and were cast by a continuous casting apparatus for an ordinary steel ingot casting apparatus by selecting, whenever necessary, an AOD (argon-oxygen blowing decarburization refining apparatus), a VOD (vacuum exhaust oxygen blowing decarburization apparatus) and an LF (molten steel ladle refining apparatus). In the case of the continuous cast slab, it was shaped into a slab having a section of 210×1,600 mm maximum or a billet having a sectional area smaller than the former. In the case of casting by the ordinary ingot casting apparatus, the cast was shaped into ingots having various sizes. Thereafter, they were forged, and testpieces having suitable sizes for subsequent investigations were produced.

Ti and Zr were added at various timings, that is, at the start of melting by the VIM or the EF, during melting, 5 minutes before completion of melting, at the start of refining by the AOD, the VOD, the LF, etc. and 10 minutes before completion of the refining process, in order to examine the precipitate compositions after casting depending on the addition timings and the influences on the shapes.

Each of the slabs so casted was cut into a length of 2 to 5 m and was subjected as a plate having a thickness of 25.4 mm to a solid solution heat-treatment at the highest heating temperature of 1,100° C. for a retention time of one hour. In the subsequent cooling process, cooling was stopped for the longest time of 24 hours at each of the temperatures of 1,080° C., 1,030° C., 980° C., 930° C., 880° C. and 830° C. and was retained at the same furnace temperature. After air cooling, residue extraction analysis of the precipitates and the precipitation forms of the carbides were examined by using a transmission electron microscope equipped with an X-ray minute portion analyzer. Further, each of the resulting thick plate was tempered at 780° C. for one hour, and was then subjected to a welding test by shaping a V-shaped butt welding groove having a groove angle of 45° shown in FIG. 1.

Welding was carried out by TIG welding, and a heat input condition employed 15,000 J/cm which is normal for ferritic heat-resistant steels. Post-heat-treatment after welding was applied to each of the joint samples so obtained at 650° C. for 6 hours, and a testpiece for the transmission electron microscope and a testpiece for the extraction residue analysis were collected from the HAZ of each joint sample in the way illustrated in FIG. 2. In this drawing, reference numeral 9 denotes a weld metal, reference numeral 10 denotes a welding heat affected zone, reference numeral 11 denotes a block testpiece for extraction residue analysis and reference numeral 12 denotes a collecting position of the testpiece on a thin film disc for the transmission electron microscope. FIG. 3 is a diagram showing the relation between the addition timing of Ti and Zr and the forms of Ti and Zr precipitates existing at the heat affected zone after welding. It can be understood that in order for the Ti and Zr precipitates to serve as the precipitation nuclei of $M_{23}C_6$ and to undergo solid solution in the constituent metal element M of this $M_{23}C_6$, Ti and Zr must exist in advance as very fine carbides, and for this purpose, they must be added under the low oxygen concentration state, that is, during VOD or LF refining, and moreover, 10 minutes before the start of continuous casting. When the sizes of the Ti and Zr precipitates before welding were examined by the electron microscope, the mean size as the carbide was found to be about 0.15 μm. The mean particle diameter of the precipitate shown in FIG. 3 represents the result of the precipitates in the welding heat affected zone and in the welding heat affected zone after the subsequent welding post-heat treatment.

Figure 4:
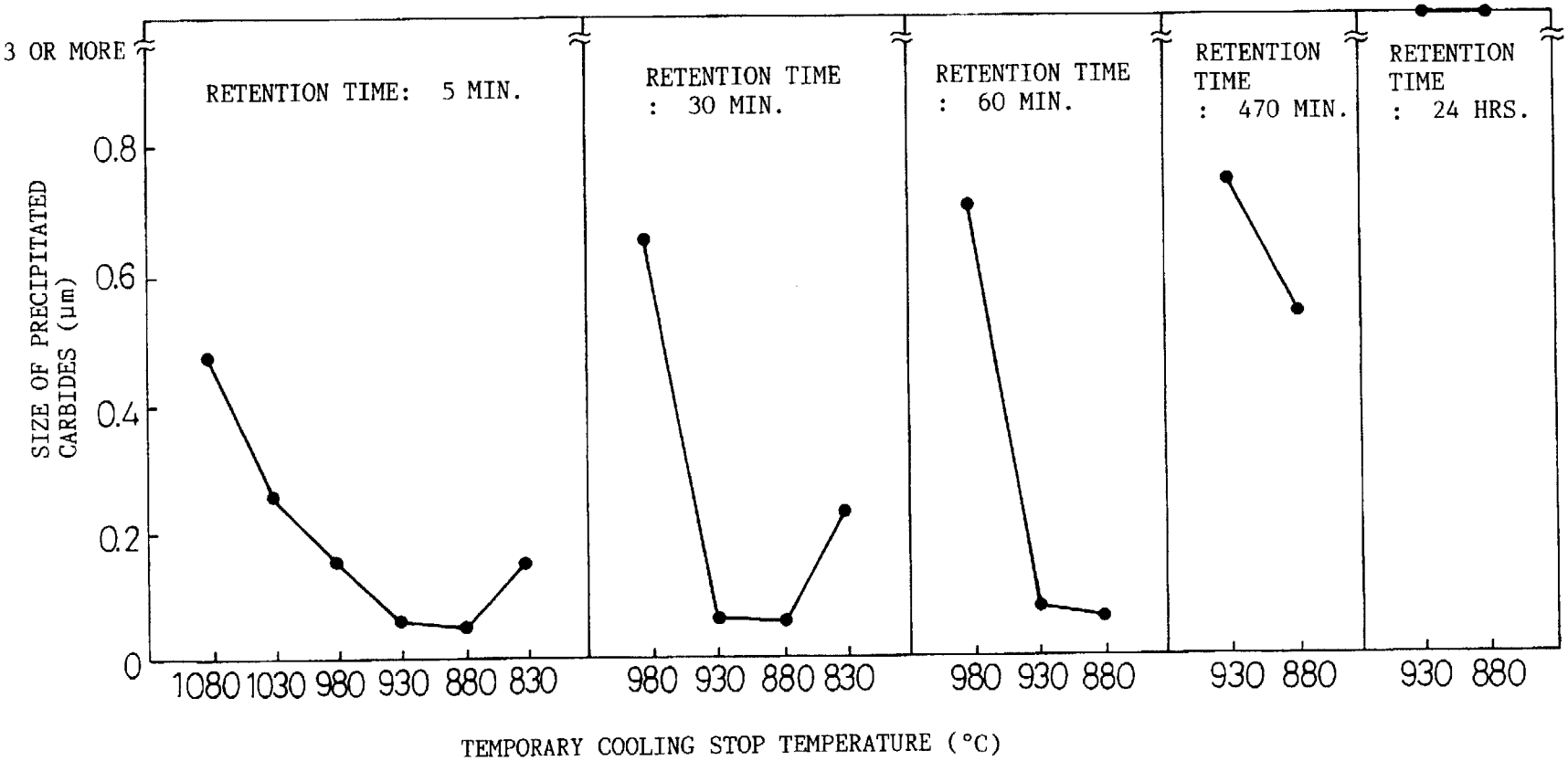
FIG. 4 is a diagram showing the relation of the size of precipitate carbides with a cooling temporary stop temperature after solid solution heat-treatment and a retention time.

FIG. 4 is a diagram showing the cooling stop temperature after the solid solution heat-treatment and its retention time with respect to the size of the precipitated carbide. The production process in this case was limited to EF-LF-CC. The size of the precipitated carbide was the smallest at the cooling stop and retention temperatures of 880° C. and 930° C., and reprecipitation could be confirmed at the retention time of 5 to 60 minutes. At the same time, it could also be confirmed that the mean size could be made the smallest in this case.

Figure 5:
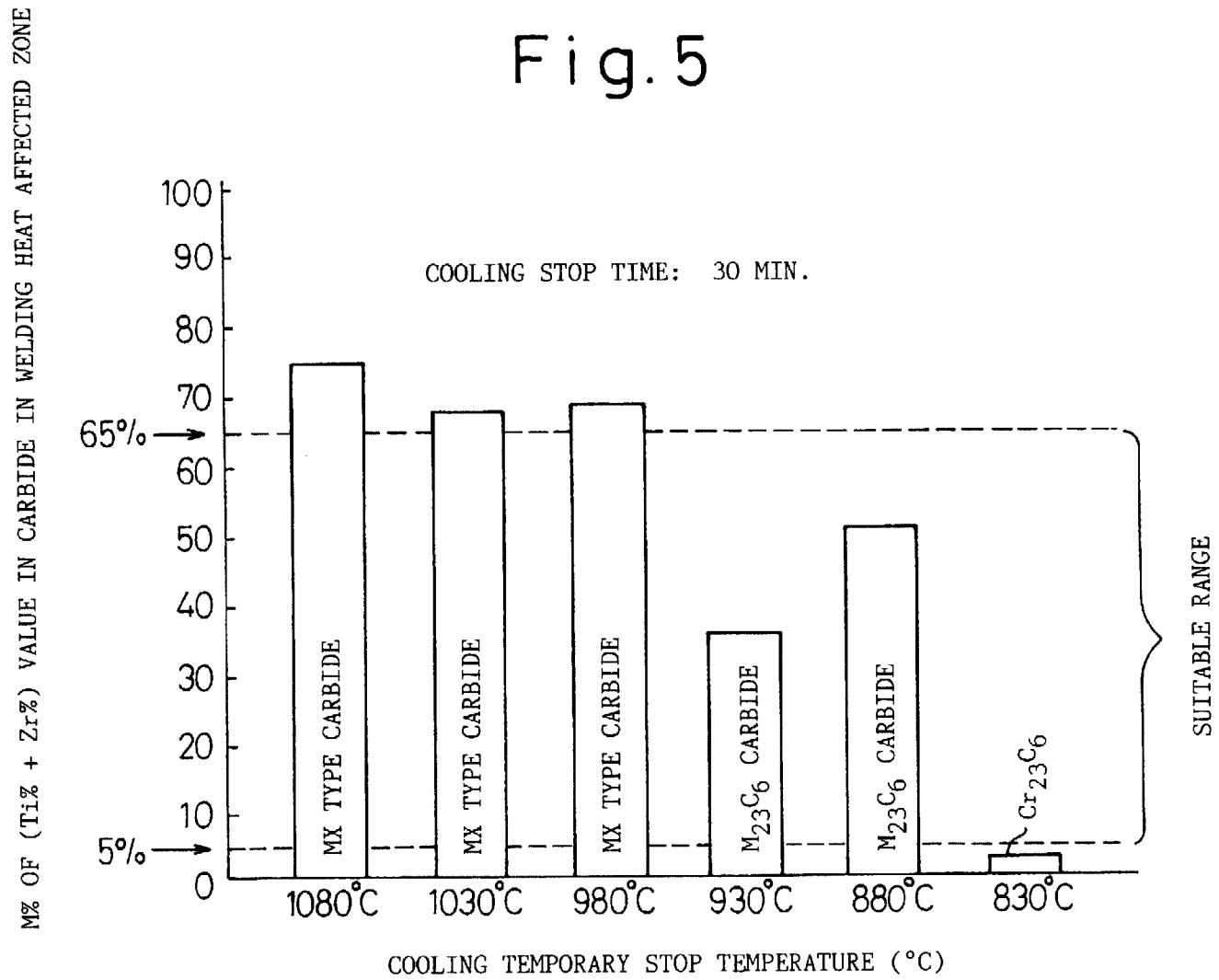
FIG. 5 is a diagram showing the relation of the configuration of precipitation at HAZ with a cooling temporary stop temperature.

It was clarified by a very small portion X-ray analyzer that the composition of the carbide was the MX type carbide consisting principally of Ti and Zr. FIG. 5 shows the relation of the forms and compositions of the precipitates with respect to the cooling stop temperature after the process steps of stopping cooling at various temperatures after solid solution heat-treatment, holding each sample for 30 minutes, cooling the sample with air, tempering the sample at 750° C., and further applying welding and post-heat treatment after welding. The carbide that took the finest precipitation form before the tempering treatment functioned as the precipitation nuclei of $M_{23}C_6$, underwent solid solution mutually with $M_{23}C_6$ precipitated during the tempering treatment, and finally became the $M_{23}C_6$ type carbide. It was found out that Ti and Zr existed as the solid solution in a proportion of 5 to 65 in the constituent metal element M.

Figure 6:
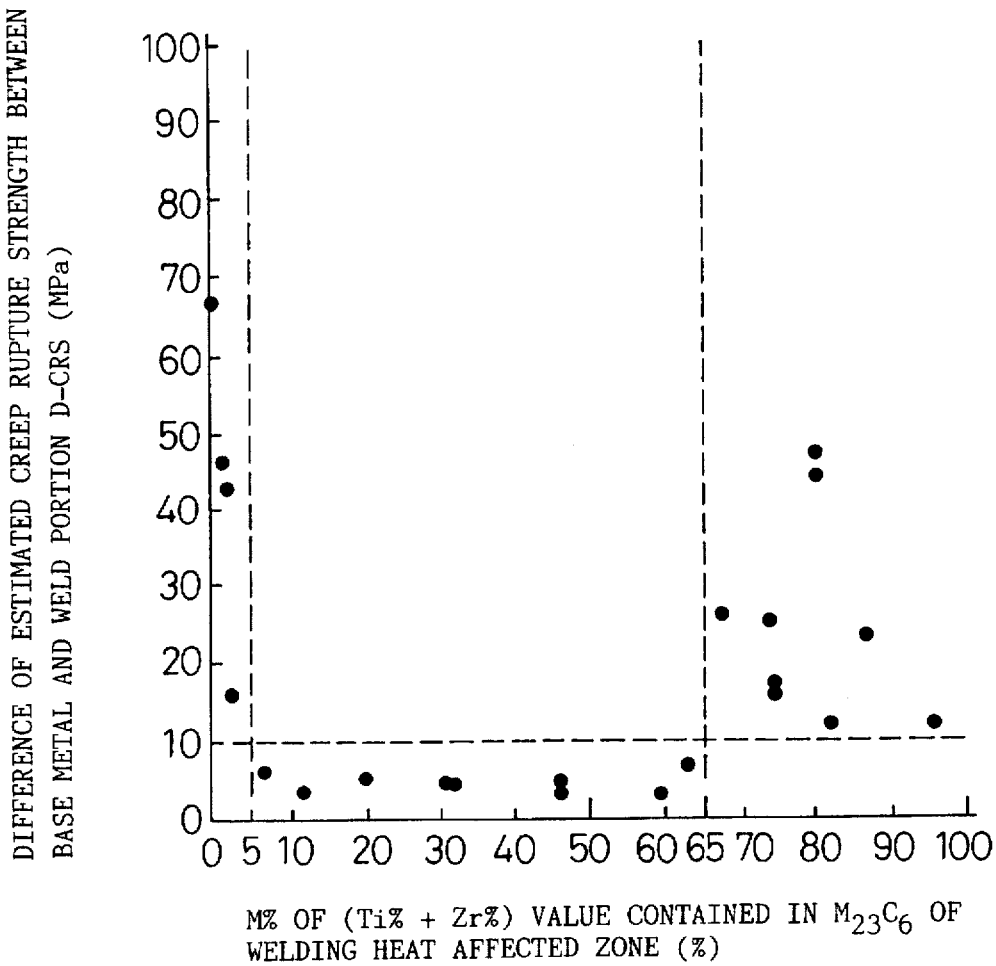
FIG. 6 is a diagram showing the relation between the difference D-CRS of a linear extrapolation estimated creep rupture strength, at 600° C. for 100,000 hours, of a base metal from that of a weld portion and M % of a (Ti %+Zr %) value in $M_{23}C_6$ type carbide in a welding heat affected zone.

FIG. 6 is a diagram showing the relation between M % of the Ti %+Zr % value in the $M_{23}C_6$ type carbide existing in the welding heat affected zone and the difference D-CRS (MPa) between the creep rupture strength of the welding heat affected zone and the creep rupture strength of the base metal portion. When M % fell between 5 and 65, the creep rupture strength of the welding heat affected zone dropped only 7 MPa maximum in comparison with the rupture strength of the base metal portion. Since this difference was within the deviation 10 MP of the data of the creep rupture strength of the base metal, it was assumed that the welding heat affected zone no longer exhibited the HAZ softening phenomenon resulting from decomposition of the precipitates. In comparison with ordinary $M_{23}C_6$ consisting principally of Cr, the $M_{23}C_6$ type carbide containing 5 to 65% of Ti and Zr in the constituent metal element M had higher decomposition temperature, and even when affected by welding heat, it was more difficult to aggregate into coarse particles. Moreover, it could be concluded that because it was extremely difficult for W and Mo to undergo solid solution in place of, or in addition to, Ti and Zr, from the aspects of their chemical affinity and from the phase diagram, the experimental results described above were found.

On the basis of the conclusion described above, the specific production processes are stipulated as set forth in the appended claims. Unless the specific production process of the present invention is applied, the carbide $M_{23}C_6$ composition of the welding heat affected zone fails to possess the HAZ softening resistance characteristics even when the steel having the chemical components that fall within the range of the present invention is produced by the ordinary process.

There is no limitation at all to the melting method of the steel according to the present invention, and a converter, an induction heating furnace, an arc melting furnace, etc, may be decided in consideration of the chemical components of the steel and the cost to employ the process to be used. However, the smelting process must be equipped with a hopper capable of adding Ti and Zr and moreover, capable of controlling an oxygen concentration to a sufficiently low concentration so that at least 90% of these addition elements can precipitate as the carbides. For this reason, it is effective to employ the LF equipped with an Ar gas blowing apparatus or with an arc heater or a plasma heater for reducing the $O_2$ concentration in the molten steel, or a vacuum degassing treatment, and they improve the effects of the present invention. In the subsequent rolling process or in the pipe making rolling process for producing steel pipes, solid solution heat-treatment directed to uniform re-solid solution of the precipitates is essentially necessary, and equipment capable of stopping cooling and holding the temperature in the cooling process, more concretely a furnace capable of heating up to about 1,000° C. at the highest, is necessary. All the other production processes, which are believed necessary or useful for producing the steel or steel products in accordance with the present invention, such as rolling, heat-treatment, pipe production, welding, cutting, inspection, and so forth, can be suitably applied, and they do not at all hinder the effects of the present invention.

As the production process of the steel pipes, in particular, it is possible to employ a method which shapes the steel to a round billet or a square billet and then processes the billet into a seamless pipe and tube by hot extrusion or various seamless rolling methods, a method which produces seam welded pipes by hot rolling and then cold rolling a thin sheet and forming the pipes by electric resistance welding, and a method which produces a welded pipe by TIG, MIG, SAW, LASER and EB welding, either individually or in combination, provided that the production process according to the present invention is essentially included. Furthermore, it is possible to additionally carry out hot or warm sizing rolling after each of the methods described above, and to add various straightening processes, and such methods further expand the dimensional range of the application of the steel according to the present invention.

The steel according to the present invention can be provided in the form of a thick plate and a thin sheet, and can be used in the shapes of various heat-resistant materials by using the sheet to which the necessary heat-treatment is applied. Such a method does not at all exert any influences on the effects of the present invention.

It is further possible to apply an HIP (hot isotropic hydrostatic pressing), a CIP (cold isotropic hydrostatic pressing), a powder metallurgical method such as sintering, and products having various shapes can be produced by applying essential heat-treatment after the shaping process.

The steel pipes, the steel sheets and the heat-resistant members having various shapes described above can be subjected to various heat-treatments in accordance with objects and applications, and such treatments are important in order to fully exhibit the effects of the present invention.

Normally, there are many cases where the products are obtained through the normalization (solid solution heat-treatment) plus tempering processes, but re-temperating and normalization can be further applied either individually or in combination and they are useful, too. However, the stop of cooling after solid solution heat treatment and the subsequent retention are indispensable.

When the nitrogen or carbon content is relatively high, when the austenite stabilization element content such as Co, Ni, etc, is large and when the Cr equivalent value becomes low, so-called "subzero treatment" for cooling the steel to a temperature lower than 0° C. for avoiding the retained austenite phase can be applied, and this method is effective for fully obtaining the mechanical characteristics of the steel according to the present invention.

Each of the processes can be applied a plurality of times within the range where the material characteristics can be fully exhibited, and such a process does not exert any influence on the effects of the present invention.

In other words, the processes described above may be appropriately selected and applied to the production process of the steel according to the present invention.

EXAMPLES 300 tons, 120 tons, 60 tons, 1 ton, 300 kg, 100 kg and 50 kg of the steels of the present invention tabulated in Tables 1 to 4 with the exception of Ti and Zr were ingoted by an ordinary blast furnace-converter blowing method, VIM, EF or a laboratory vacuum melting equipment, and were refined by an LF equipment equipped with an arc re-heating device and capable of blowing Ar or by a small reproduction testing equipment having an equivalent capacity. One, or both, of Ti and Zr were added 10 minutes before the start of casting so as to regulate the chemical components and to obtain the slabs or ingots. Each of the resulting slabs was converted to a 50 mm-thick sheet or a 12 mm-thick thin sheet by hot rolling, or to a round billet. Each tube having an outer diameter of 74 mm and a thickness of 10 mm was shaped into a pipe having an outer diameter of 380 mm and a thickness of 50 mm by seamless rolling. Further, each thin sheet was subjected to electric welding to obtain an electric welded pipe having an outer diameter of 280 mm and a thickness of 12 mm.

TABLE 1

| | (mass %) | | | | | | | | | |
|---|---|---|---|---|---|---|---|---|---|---|
| No | C | Si | Mn | Cr | Mo | W | V | Nb | N | Ti |
| 1 | 0.204 | 0.35 | 0.70 | 3.00 | 0.51 | 3.42 | 0.361 | 0.363 | 0.030 | 0.286 |
| 2 | 0.158 | 0.75 | 0.41 | 0.52 | 0.07 | 0.62 | 0.900 | 0.430 | 0.045 | 0.598 |
| 3 | 0.029 | 0.29 | 0.99 | 1.50 | 1.05 | 1.57 | 0.278 | 0.252 | 0.031 | 0.797 |
| 4 | 0.203 | 0.41 | 0.29 | 2.90 | 0.96 | 2.42 | 0.785 | 0.481 | 0.064 | 0.768 |
| 5 | 0.202 | 0.19 | 0.21 | 1.84 | 0.32 | 2.66 | 0.802 | 0.068 | 0.041 | 0.779 |
| 6 | 0.123 | 0.30 | 0.60 | 4.26 | 0.36 | 1.72 | 0.159 | 0.394 | 0.079 | — |
| 7 | 0.207 | 0.21 | 0.94 | 4.93 | 0.10 | 2.36 | 0.158 | 0.151 | 0.075 | — |
| 8 | 0.115 | 0.18 | 0.28 | 3.11 | 0.78 | 0.72 | 0.651 | 0.490 | 0.014 | — |
| 9 | 0.090 | 0.08 | 0.91 | 4.84 | 0.67 | 1.26 | 0.496 | 0.350 | 0.062 | — |
| 10 | 0.232 | 0.58 | 0.69 | 4.83 | 1.00 | 3.38 | 0.500 | 0.379 | 0.022 | — |
| 11 | 0.055 | 0.75 | 0.28 | 4.66 | 0.81 | 1.64 | 0.030 | 0.261 | 0.017 | 0.568 |
| 12 | 0.095 | 0.47 | 0.76 | 1.30 | 1.32 | 0.42 | 0.872 | 0.154 | 0.030 | 0.334 |
| 13 | 0.156 | 0.79 | 0.41 | 3.04 | 0.07 | 0.84 | 0.419 | 0.470 | 0.093 | 0.684 |
| 14 | 0.047 | 0.79 | 0.26 | 4.56 | 0.52 | 0.70 | 0.964 | 0.148 | 0.100 | 0.686 |
| 15 | 0.300 | 0.35 | 0.22 | 2.97 | 0.95 | 2.77 | 0.383 | 0.336 | 0.082 | 0.615 |
| 16 | 0.145 | 0.52 | 0.54 | 4.24 | 0.37 | 1.54 | 0.958 | 0.211 | 0.022 | 0.320 |
| 17 | 0.251 | 0.36 | 0.68 | 3.09 | 0.75 | 1.41 | 0.089 | 0.186 | 0.044 | 0.095 |
| 18 | 0.292 | 0.17 | 0.93 | 1.12 | 1.13 | 1.89 | 0.064 | 0.433 | 0.041 | 0.597 |
| 19 | 0.214 | 0.58 | 0.75 | 2.05 | 0.51 | 0.75 | 0.227 | 0.126 | 0.088 | 0.494 |
| 20 | 0.260 | 0.30 | 0.80 | 2.85 | 0.87 | 2.37 | 0.416 | 0.167 | 0.036 | 0.055 |
| 21 | 0.092 | 0.76 | 0.95 | 2.84 | 1.23 | 2.98 | 0.482 | 0.237 | 0.051 | — |
| 22 | 0.100 | 0.27 | 0.69 | 1.28 | 1.35 | 2.00 | 0.745 | 0.496 | 0.071 | — |
| 23 | 0.090 | 0.27 | 0.27 | 1.93 | 0.99 | 2.21 | 0.561 | 0.375 | 0.039 | — |
| 24 | 0.160 | 0.63 | 0.76 | 4.04 | 0.63 | 1.38 | 0.249 | 0.036 | 0.073 | — |
| 25 | 0.114 | 0.04 | 0.83 | 4.57 | 0.79 | 2.28 | 0.625 | 0.129 | 0.023 | — |
| 26 | 0.051 | 0.71 | 0.74 | 2.83 | 0.45 | 2.72 | 0.564 | 0.097 | 0.011 | 0.251 |
| 27 | 0.073 | 0.58 | 0.38 | 2.58 | 0.89 | 0.52 | 0.384 | 0.338 | 0.021 | 0.592 |

TABLE 1-continued

| | (mass %) | | | | | | | | | |
|---|---|---|---|---|---|---|---|---|---|---|
| No | C | Si | Mn | Cr | Mo | W | V | Nb | N | Ti |
| 28 | 0.126 | 0.69 | 0.80 | 3.13 | 1.11 | 1.76 | 0.916 | 0.046 | 0.085 | 0.754 |
| 29 | 0.022 | 0.51 | 0.68 | 3.67 | 0.12 | 2.55 | 0.516 | 0.112 | 0.051 | 0.594 |
| 30 | 0.290 | 0.70 | 0.69 | 1.25 | 0.65 | 0.73 | 0.988 | 0.215 | 0.085 | 0.393 |
| 31 | 0.162 | 0.75 | 0.68 | 4.08 | 0.22 | 2.34 | 0.694 | 0.024 | 0.037 | 0.401 |
| 32 | 0.017 | 0.11 | 0.54 | 2.47 | 0.83 | 0.24 | 0.958 | 0.202 | 0.028 | 0.108 |
| 33 | 0.106 | 0.64 | 0.93 | 2.42 | 1.48 | 2.15 | 0.138 | 0.174 | 0.087 | 0.566 |
| 34 | 0.086 | 0.24 | 0.91 | 0.94 | 1.18 | 0.91 | 0.523 | 0.103 | 0.066 | 0.060 |
| 35 | 0.205 | 0.35 | 0.37 | 4.06 | 1.20 | 2.63 | 0.987 | 0.406 | 0.040 | 0.452 |
| 36 | 0.122 | 0.46 | 0.77 | 2.05 | 1.28 | 1.78 | 0.380 | 0.203 | 0.083 | — |
| 37 | 0.224 | 0.03 | 0.77 | 0.88 | 0.42 | 1.12 | 0.984 | 0.082 | 0.046 | — |
| 38 | 0.173 | 0.51 | 0.24 | 4.30 | 1.35 | 3.38 | 0.681 | 0.272 | 0.093 | — |

TABLE 2

| | (mass %) | | | | | | | | |
|---|---|---|---|---|---|---|---|---|---|
| No | Zr | Co | Ni | P | S | O | D-CRS | HAZCRS | M % |
| 1 | — | — | — | 0.019 | 0.0065 | 0.0103 | 6 | 136 | 23 |
| 2 | — | — | — | 0.029 | 0.0048 | 0.0101 | 1 | 133 | 39 |
| 3 | — | — | — | 0.011 | 0.0003 | 0.0152 | 7 | 131 | 32 |
| 4 | — | — | — | 0.026 | 0.0075 | 0.0032 | 6 | 142 | 32 |
| 5 | — | — | — | 0.002 | 0.0007 | 0.0180 | 2 | 137 | 40 |
| 6 | 0.518 | — | — | 0.021 | 0.0016 | 0.0126 | 5 | 134 | 35 |
| 7 | 0.612 | — | — | 0.003 | 0.0015 | 0.0063 | 7 | 134 | 37 |
| 8 | 0.645 | — | — | 0.023 | 0.0052 | 0.0061 | 3 | 132 | 38 |
| 9 | 0.997 | — | — | 0.009 | 0.0064 | 0.0168 | 0 | 130 | 15 |
| 10 | 0.735 | — | — | 0.029 | 0.0024 | 0.0008 | 3 | 140 | 24 |
| 11 | 0.706 | — | — | 0.002 | 0.0090 | 0.0171 | 6 | 133 | 50 |
| 12 | 0.345 | — | — | 0.020 | 0.0066 | 0.0038 | 4 | 130 | 30 |
| 13 | 0.752 | — | — | 0.008 | 0.0034 | 0.0148 | 4 | 139 | 68 |
| 14 | 0.516 | — | — | 0.022 | 0.0067 | 0.0128 | 1 | 137 | 51 |
| 15 | 0.122 | — | — | 0.009 | 0.0076 | 0.0170 | 3 | 141 | 33 |
| 16 | — | 3.75 | 0.45 | 0.016 | 0.0062 | 0.0151 | 1 | 131 | 24 |
| 17 | — | 0.34 | 4.40 | 0.013 | 0.0010 | 0.0112 | 0 | 128 | 19 |
| 18 | — | 1.97 | 4.09 | 0.012 | 0.0039 | 0.0177 | 7 | 135 | 21 |
| 19 | — | 1.43 | 1.25 | 0.005 | 0.0016 | 0.0047 | 2 | 130 | 30 |
| 20 | — | 2.82 | 1.78 | 0.008 | 0.0083 | 0.0185 | 2 | 131 | 9 |
| 21 | 0.697 | 2.43 | 1.42 | 0.008 | 0.0034 | 0.0048 | 4 | 138 | 27 |
| 22 | 0.032 | 0.81 | 4.87 | 0.014 | 0.0035 | 0.0147 | 5 | 136 | 7 |
| 23 | 0.698 | 2.65 | 1.84 | 0.004 | 0.0049 | 0.0087 | 6 | 136 | 29 |
| 24 | 0.283 | 4.85 | 0.62 | 0.011 | 0.0026 | 0.0035 | 3 | 128 | 18 |
| 25 | 0.286 | 3.81 | 4.21 | 0.019 | 0.0098 | 0.0039 | 2 | 131 | 19 |
| 26 | 0.082 | 4.80 | 2.90 | 0.024 | 0.0093 | 0.0020 | 5 | 130 | 19 |
| 27 | 0.149 | 2.85 | 0.71 | 0.004 | 0.0070 | 0.0072 | 3 | 129 | 32 |
| 28 | 0.482 | 4.57 | 1.25 | 0.020 | 0.0075 | 0.0170 | 2 | 139 | 43 |
| 29 | 0.179 | 1.55 | 2.72 | 0.029 | 0.0049 | 0.0165 | 4 | 134 | 40 |
| 30 | 0.231 | 3.90 | 0.21 | 0.026 | 0.0014 | 0.0077 | 1 | 136 | 37 |
| 31 | — | 1.87 | — | 0.018 | 0.0026 | 0.0097 | 1 | 132 | 32 |
| 32 | — | 4.40 | — | 0.022 | 0.0086 | 0.0101 | 6 | 126 | 24 |
| 33 | — | 0.59 | — | 0.024 | 0.0082 | 0.0135 | 3 | 134 | 25 |
| 34 | — | 3.01 | — | 0.005 | 0.0086 | 0.0022 | 6 | 127 | 11 |
| 35 | — | 4.33 | — | 0.030 | 0.0060 | 0.0055 | 6 | 140 | 23 |
| 36 | 0.392 | 1.52 | — | 0.028 | 0.0098 | 0.0105 | 6 | 134 | 20 |
| 37 | 0.466 | 2.80 | — | 0.001 | 0.0042 | 0.0123 | 5 | 132 | 30 |
| 38 | 0.779 | 1.59 | — | 0.002 | 0.0010 | 0.0031 | 5 | 144 | 28 |

D-CRS: difference of estimated creep rupture strength by linear extrapolation at 550° C. for 100,000 hours between base metal and weld portion (MPa)

HAZCRS: estimated creep rupture strength by linear extrapolation at 550° C. for 100,000 hours, of weld portion (MPa)

M %: (Ti % + Zr %) value M % in $M_{23}C_6$ type carbide in welding heat affected portion (%)

TABLE 3

| | (mass %) | | | | | | | | | |
|---|---|---|---|---|---|---|---|---|---|---|
| No | C | Si | Mn | Cr | Mo | W | V | Nb | N | Ti |
| 39 | 0.214 | 0.20 | 0.65 | 4.86 | 0.87 | 3.10 | 0.779 | 0.017 | 0.078 | — |
| 40 | 0.151 | 0.15 | 0.28 | 1.82 | 0.21 | 3.06 | 0.639 | 0.221 | 0.069 | — |
| 41 | 0.228 | 0.62 | 0.99 | 3.43 | 1.61 | 2.68 | 0.579 | 0.314 | 0.058 | 0.650 |
| 42 | 0.255 | 0.71 | 0.65 | 2.22 | 0.36 | 3.10 | 0.935 | 0.458 | 0.028 | 0.035 |
| 43 | 0.035 | 0.67 | 0.32 | 4.19 | 0.70 | 2.10 | 0.563 | 0.327 | 0.099 | 0.469 |
| 44 | 0.249 | 0.76 | 0.69 | 1.86 | 0.62 | 0.81 | 0.772 | 0.088 | 0.032 | 0.622 |
| 45 | 0.124 | 0.48 | 0.41 | 3.43 | 1.37 | 1.96 | 0.414 | 0.145 | 0.081 | 0.349 |
| 46 | 0.187 | 0.46 | 0.55 | 1.53 | 1.23 | 3.41 | 0.323 | 0.425 | 0.052 | 0.335 |
| 47 | 0.253 | 0.59 | 0.99 | 2.06 | 1.44 | 2.90 | 0.813 | 0.104 | 0.019 | 0.030 |
| 48 | 0.122 | 0.33 | 0.78 | 4.29 | 0.24 | 3.22 | 0.265 | 0.093 | 0.060 | 0.130 |
| 49 | 0.191 | 0.37 | 0.21 | 3.08 | 1.16 | 0.55 | 0.964 | 0.301 | 0.022 | 0.476 |
| 50 | 0.256 | 0.14 | 0.33 | 4.32 | 0.19 | 2.57 | 0.292 | 0.408 | 0.028 | 0.556 |
| 51 | 0.135 | 0.34 | 0.62 | 0.63 | 0.08 | 0.51 | 0.557 | 0.336 | 0.062 | — |
| 52 | 0.065 | 0.43 | 0.55 | 4.71 | 0.60 | 0.43 | 0.113 | 0.245 | 0.019 | — |
| 53 | 0.290 | 0.29 | 0.39 | 2.34 | 1.48 | 1.77 | 0.764 | 0.300 | 0.065 | — |
| 54 | 0.036 | 0.17 | 0.81 | 4.04 | 1.01 | 2.36 | 0.391 | 0.180 | 0.095 | — |
| 55 | 0.273 | 0.34 | 0.46 | 4.57 | 1.16 | 1.65 | 0.301 | 0.290 | 0.048 | — |
| 56 | 0.226 | 0.68 | 0.84 | 0.95 | 0.22 | 0.74 | 0.823 | 0.306 | 0.046 | 0.374 |
| 57 | 0.281 | 0.28 | 0.58 | 1.36 | 0.88 | 2.38 | 0.322 | 0.144 | 0.073 | 0.472 |
| 58 | 0.104 | 0.14 | 0.38 | 2.89 | 0.70 | 1.10 | 0.601 | 0.466 | 0.070 | 0.447 |
| 59 | 0.080 | 0.58 | 0.90 | 2.53 | 0.91 | 2.93 | 0.025 | 0.202 | 0.066 | 0.166 |
| 60 | 0.015 | 0.27 | 0.39 | 1.79 | 1.27 | 0.76 | 0.402 | 0.262 | 0.048 | 0.302 |
| 61 | 0.157 | 0.27 | 0.35 | 2.23 | 0.06 | 0.65 | 0.591 | 0.072 | 0.046 | 0.728 |
| 62 | 0.021 | 0.05 | 0.24 | 0.83 | 1.48 | 0.40 | 0.427 | 0.285 | 0.089 | 0.504 |
| 63 | 0.283 | 0.66 | 0.32 | 3.55 | 0.83 | 1.10 | 0.725 | 0.085 | 0.073 | 0.299 |
| 64 | 0.024 | 0.40 | 0.46 | 0.71 | 0.85 | 2.23 | 0.353 | 0.373 | 0.073 | 0.383 |
| 65 | 0.069 | 0.32 | 0.52 | 2.81 | 1.28 | 1.60 | 0.125 | 0.335 | 0.075 | 0.631 |
| 66 | 0.082 | 0.30 | 0.40 | 4.63 | 0.40 | 0.31 | 0.865 | 0.135 | 0.063 | — |
| 67 | 0.013 | 0.20 | 0.74 | 0.90 | 0.94 | 1.12 | 0.445 | 0.180 | 0.023 | — |
| 68 | 0.104 | 0.28 | 0.21 | 2.14 | 1.16 | 1.83 | 0.666 | 0.145 | 0.030 | — |
| 69 | 0.018 | 0.03 | 0.29 | 0.86 | 0.08 | 0.26 | 0.880 | 0.197 | 0.025 | — |
| 70 | 0.142 | 0.49 | 0.84 | 3.06 | 1.17 | 0.81 | 0.430 | 0.252 | 0.036 | — |
| 71 | 0.282 | 0.36 | 0.94 | 1.27 | 1.21 | 1.28 | 0.144 | 0.232 | 0.095 | 0.086 |
| 72 | 0.103 | 0.68 | 0.44 | 3.72 | 1.44 | 1.13 | 0.830 | 0.302 | 0.052 | 0.168 |
| 73 | 0.138 | 0.55 | 0.43 | 0.74 | 0.88 | 3.16 | 0.872 | 0.138 | 0.073 | 0.559 |
| 74 | 0.194 | 0.62 | 0.38 | 0.56 | 0.04 | 0.21 | 0.596 | 0.149 | 0.052 | 0.727 |
| 75 | 0.077 | 0.36 | 0.54 | 4.67 | 0.90 | 3.26 | 0.322 | 0.497 | 0.020 | 0.545 |

TABLE 4

| | (mass %) | | | | | | | | |
|---|---|---|---|---|---|---|---|---|---|
| No | Zr | Co | Ni | P | S | O | D-CRS | HAZCRS | M % |
| 39 | 0.220 | 4.99 | — | 0.022 | 0.0015 | 0.0121 | 4 | 136 | 10 |
| 40 | 0.771 | 2.71 | — | 0.022 | 0.0055 | 0.0070 | 3 | 139 | 39 |
| 41 | 0.719 | 3.08 | — | 0.016 | 0.0066 | 0.0119 | 3 | 143 | 47 |
| 42 | 0.651 | 4.20 | — | 0.014 | 0.0072 | 0.0095 | 5 | 142 | 35 |
| 43 | 0.654 | 1.21 | — | 0.009 | 0.0083 | 0.0091 | 0 | 140 | 45 |
| 44 | 0.311 | 2.98 | — | 0.017 | 0.0097 | 0.0179 | 1 | 132 | 46 |
| 45 | 0.312 | 1.11 | — | 0.010 | 0.0053 | 0.0109 | 0 | 135 | 22 |
| 46 | — | — | 4.80 | 0.027 | 0.0021 | 0.0100 | 2 | 139 | 16 |
| 47 | — | — | 0.27 | 0.016 | 0.0062 | 0.0149 | 6 | 134 | 8 |
| 48 | — | — | 2.86 | 0.011 | 0.0074 | 0.0030 | 6 | 132 | 15 |
| 49 | — | — | 1.13 | 0.024 | 0.0095 | 0.0183 | 6 | 132 | 25 |
| 50 | — | — | 2.17 | 0.008 | 0.0049 | 0.0039 | 3 | 136 | 35 |
| 51 | 0.227 | — | 2.93 | 0.029 | 0.0043 | 0.0185 | 6 | 129 | 30 |
| 52 | 0.664 | — | 2.07 | 0.001 | 0.0028 | 0.0199 | 7 | 125 | 34 |
| 53 | 0.146 | — | 4.97 | 0.027 | 0.0038 | 0.0028 | 2 | 136 | 14 |
| 54 | 0.043 | — | 1.91 | 0.015 | 0.0096 | 0.0090 | 3 | 132 | 12 |
| 55 | 0.456 | — | 4.26 | 0.029 | 0.0068 | 0.0084 | 4 | 133 | 19 |
| 56 | 0.168 | — | 1.11 | 0.016 | 0.0048 | 0.0081 | 1 | 132 | 38 |
| 57 | 0.265 | — | 2.59 | 0.003 | 0.0023 | 0.0029 | 0 | 137 | 31 |
| 58 | 0.535 | — | 1.42 | 0.016 | 0.0015 | 0.0146 | 6 | 137 | 49 |
| 59 | 0.262 | — | 1.70 | 0.017 | 0.0084 | 0.0036 | 3 | 134 | 22 |
| 60 | 0.233 | — | 2.15 | 0.024 | 0.0081 | 0.0061 | 0 | 129 | 28 |
| 61 | — | 3.58 | 0.92 | 0.023 | 0.0042 | 0.0073 | 2 | 129 | 41 |
| 62 | — | 1.98 | 2.70 | 0.009 | 0.0039 | 0.0095 | 0 | 130 | 20 |
| 63 | — | 0.70 | 2.06 | 0.018 | 0.0034 | 0.0024 | 2 | 132 | 27 |

TABLE 4-continued

| | (mass %) | | | | | | | | |
|---|---|---|---|---|---|---|---|---|---|
| No | Zr | Co | Ni | P | S | O | D-CRS | HAZCRS | M % |
| 64 | — | 3.82 | 2.47 | 0.024 | 0.0072 | 0.0125 | 2 | 134 | 23 |
| 65 | — | 2.82 | 2.05 | 0.012 | 0.0092 | 0.0052 | 4 | 133 | 29 |
| 66 | 0.252 | 0.71 | 0.73 | 0.022 | 0.0068 | 0.0024 | 0 | 128 | 30 |
| 67 | 0.359 | 2.14 | 0.26 | 0.016 | 0.0010 | 0.0135 | 1 | 127 | 27 |
| 68 | 0.213 | 4.11 | 4.15 | 0.013 | 0.0063 | 0.0161 | 2 | 130 | 11 |
| 69 | 0.489 | 0.46 | 3.29 | 0.012 | 0.0019 | 0.0050 | 5 | 127 | 42 |
| 70 | 0.178 | 1.34 | 4.82 | 0.009 | 0.0045 | 0.0117 | 1 | 128 | 14 |
| 71 | 0.166 | 1.87 | 3.26 | 0.025 | 0.0057 | 0.0065 | 4 | 132 | 12 |
| 72 | 0.438 | 1.38 | 2.12 | 0.020 | 0.0050 | 0.0062 | 6 | 134 | 21 |
| 73 | 0.483 | 0.95 | 4.32 | 0.022 | 0.0012 | 0.0055 | 3 | 142 | 35 |
| 74 | 0.487 | 1.16 | 5.00 | 0.027 | 0.0014 | 0.0188 | 0 | 132 | 58 |
| 75 | 0.133 | 1.89 | 1.07 | 0.027 | 0.0068 | 0.0094 | 1 | 138 | 24 |

D-CRS: difference of estimated creep rupture strength by linear extrapolation at 550° C. for 100,000 hours between base metal and weld portion (MPa)
HAZCRS: estimated creep rupture strength by linear extrapolation at 550° C. for 100,000 hours, of weld portion (MPa)
M %: (Ti % + Zr %) value M % in $M_{23}C_6$ type carbide in welding heat affected portion (%)

All the sheets and pipes were subjected to the solid solution heat-treatment. Cooling was temporarily stopped at a temperature within the range of 880° to 930° C., and after the steel products were retained inside the furnace for 5 to 60 minutes, they were cooled by air. Furthermore, the tempering treatment was carried out at 750° C. for one hour.

Edge preparation was performed on each sheet in exactly the same way as in FIG. 1, while a groove was formed at a pipe end for each pipe in the circumferential direction in the same way as in FIG. 1 and circumferential joint welding of the pipes was carried out by TIG or SAW welding. Softening annealing (PWHT) was locally applied to each weld portion at 650° C. for 6 hours.

Figure 7A:
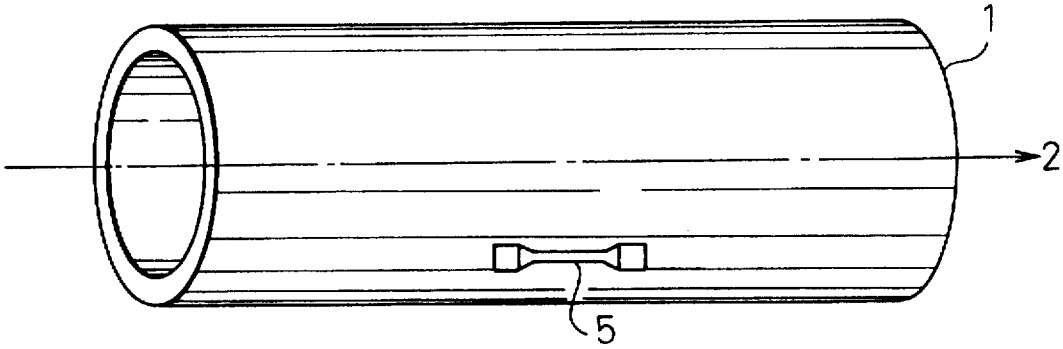
FIGS. 7(*a*) and 7(*b*) show a method of collecting a testpiece for a creep rupture strength test from a steel pipe and from a sheet material, respectively.
Figure 7B:
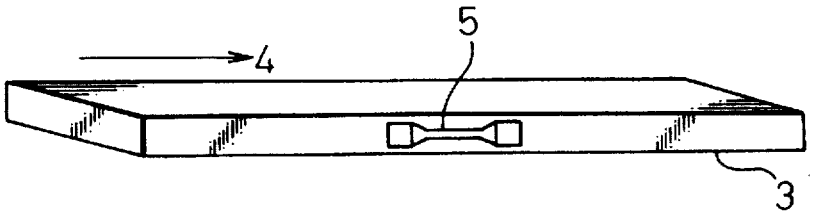

To examine the creep characteristics of the base metal, a creep testpiece 5 having a diameter of 6 mm was cut out from a portion other than the weld portion or the welding heat affected zone in parallel with the axial direction 2 of the steel pipe 1 in the case of the pipe as shown in FIG. 7(*a*), and in parallel with the rolling direction 4 of the sheet material 3 in the case of the sheet material as shown in FIG. 7(*b*). The creep rupture strength of each testpiece was measured at 550° C., and the resulting data were extrapolated linearly to obtain the creep rupture strength for 100,000 hours.

Figure 8:
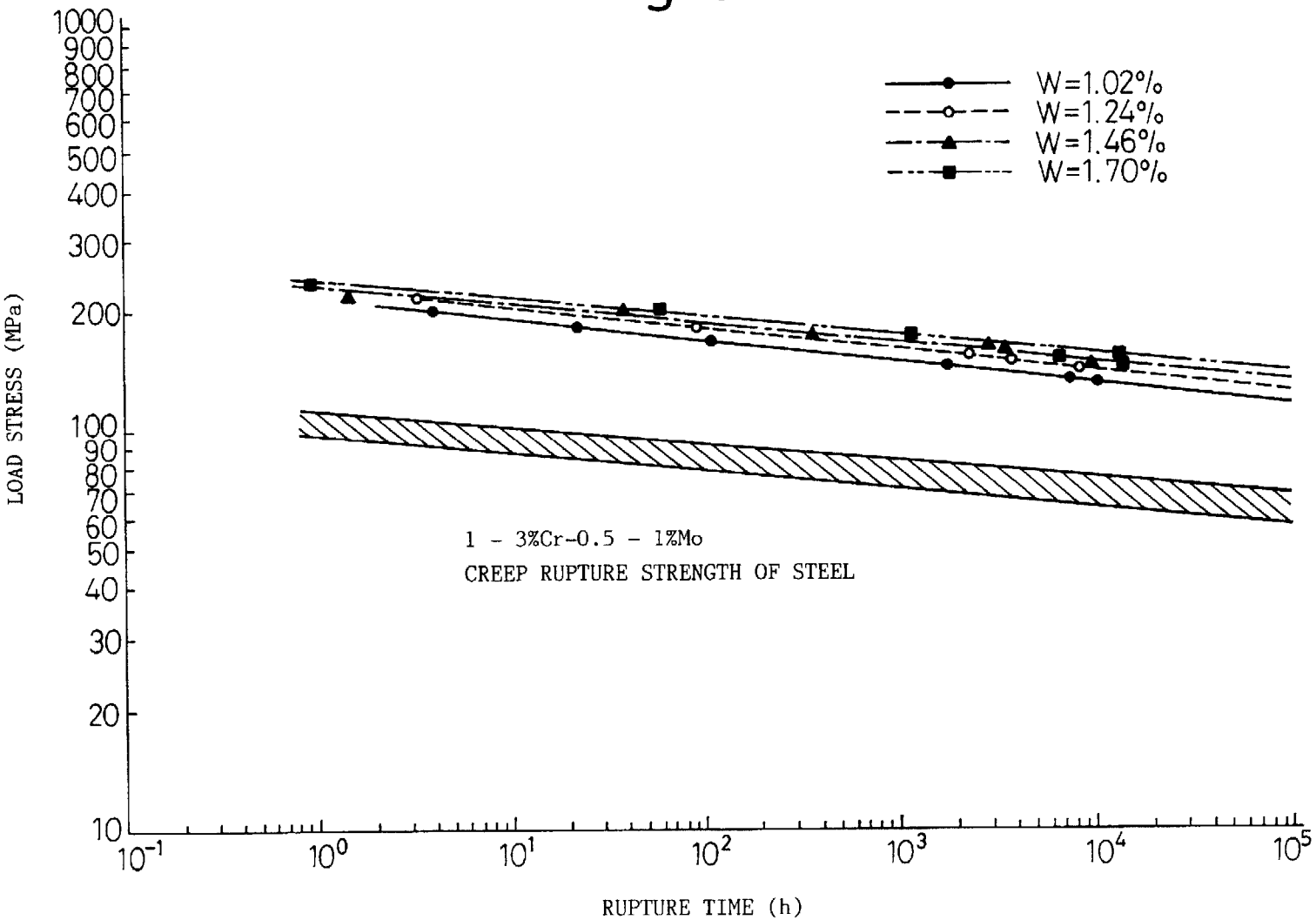
FIG. 8 is a diagram showing the relation between a rupture time of the creep rupture test and an applied stress.

FIG. 8 shows the measurement results of the creep rupture strength of the base metals up to 10,000 hours together with the extrapolation line of the estimated rupture strength for 100,000 hours. It can be seen that the high temperature creep rupture strength of the steels of the present invention was higher than that of the conventional low alloy steels and 1 to 3%Cr–0.5 to 1%Mo steels.

Figure 9A:
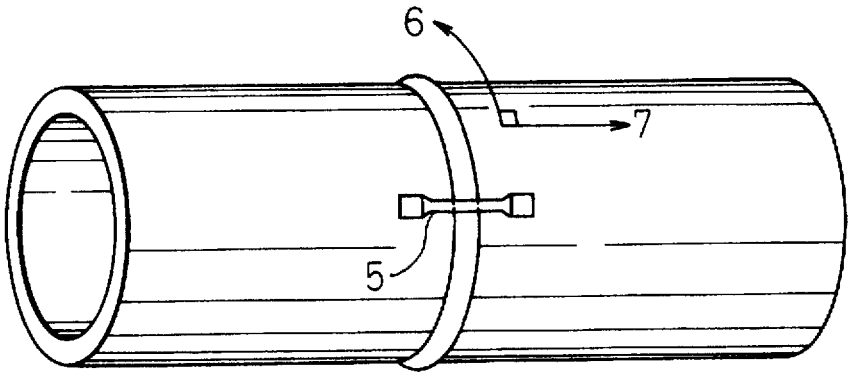
FIGS. 9(*a*) and 9(*b*) show a method of collecting a testpiece for the creep rupture test from a steel pipe and from a sheet material, respectively.
Figure 9B:
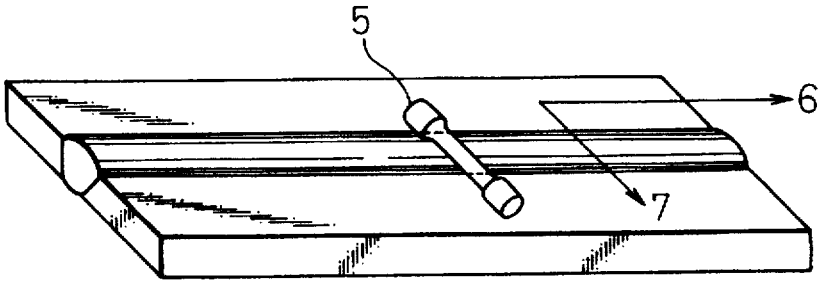

To examine the creep characteristics of the weld portion, each creep rupture testpiece 5 having a diameter of 6 mm was cut out in parallel with the axial direction 7 of each steel pipe as shown in FIG. 9(*a*) or from the orthogonal direction 7 with respect to the weld line 6, and the measurement results of the rupture strength at 550° C. were linearly extrapolated up to 100,000 hours for the comparison and evaluation with the creep characteristics of the base metal. Hereinafter, the term "creep rupture strength" will represent the linear extrapolation estimated rupture strength at 550° C. for 100,000 hours for the sake of convenience of the explanation of the present invention. The difference of the creep linear extrapolation rupture strength estimated values between the base metal and the weld portion, that is, (creep rupture estimated strength of the base metal)—(HAZ creep rupture estimated strength), i.e. D-CRS(MPa), was used as an index of the "HAZ softening" resistance. Though the D-CRS value is somehow affected by the collecting direction of the creep rupture testpiece with respect to the rolling direction of the testpiece, it has been empirically clarified by preparatory experiments that its influence is within 5 MPa. Accordingly, when the D-CRS value is not greater than 10 MPa, the value represents that the HAZ softening resistance characteristics of the materials are extremely excellent.

Figure 2:
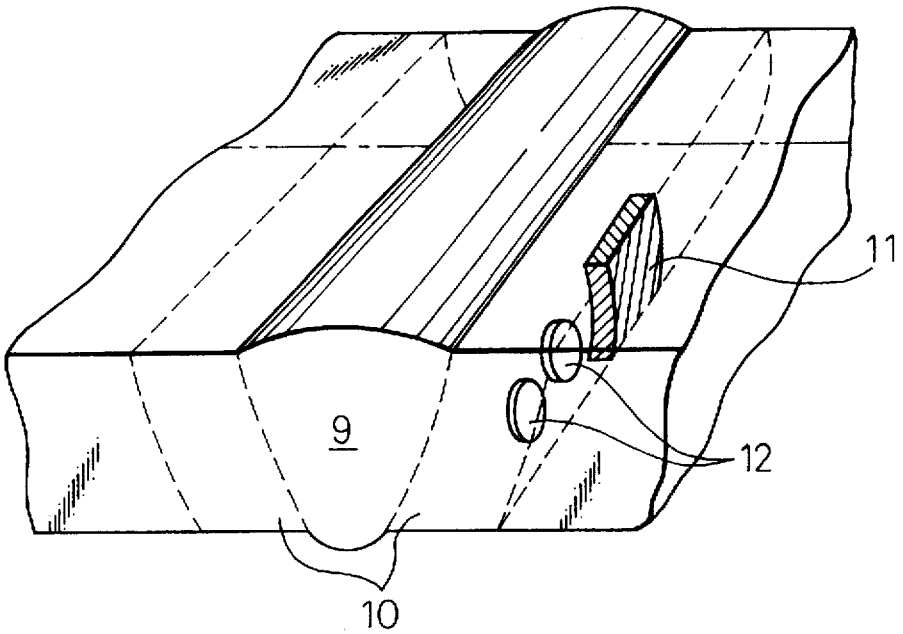
FIG. 2 shows a method of collecting a testpiece for the analysis of a precipitate at a welding heat affected zone.
Figure 3:
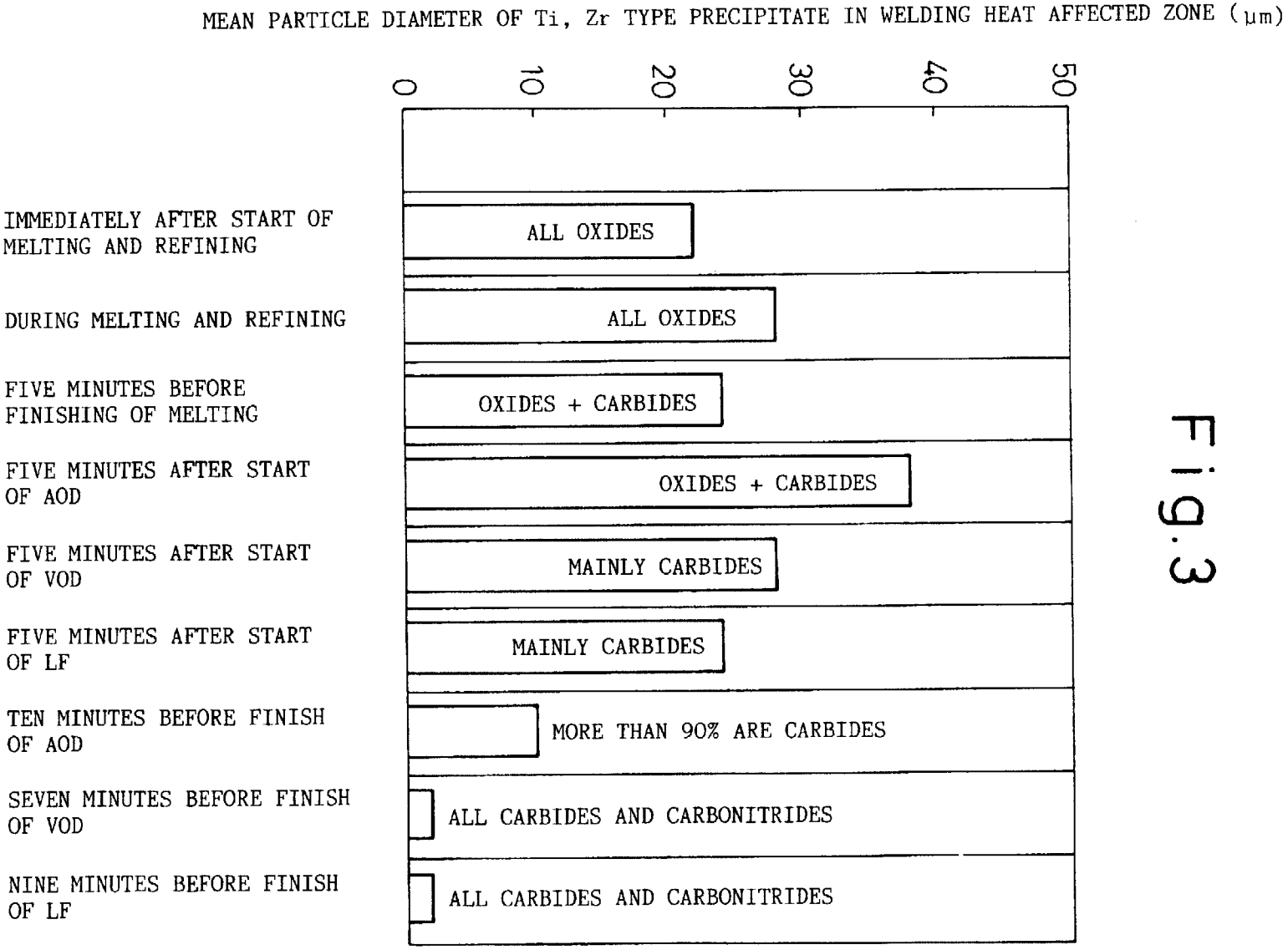
FIG. 3 is a diagram showing the relation between the addition timing of Ti and Zr and the existence form of Ti and Zr as a precipitate in a steel.

As to the precipitates of the HAZ portion, each testpiece was collected in the same way as in FIG. 2, and the residues were extracted by an acid dissolution method. After $M_{23}C_6$ was determined, the composition in its M was determined by a very small portion scanning X-ray analyzer. The (Ti %+Zr %) value at this time was expressed as M %, and was evaluated. On the basis of the experimental results, the evaluation standard was set so that the value of M % had to fall within the range of 5 to 65. In other words, when the M value was not greater than 5 or not smaller than 65%, HAZ-CRS dropped.

In order to indirectly evaluate the behaviour of the precipitates of the HAZ, the toughness test was carried out.

Figure 10A:
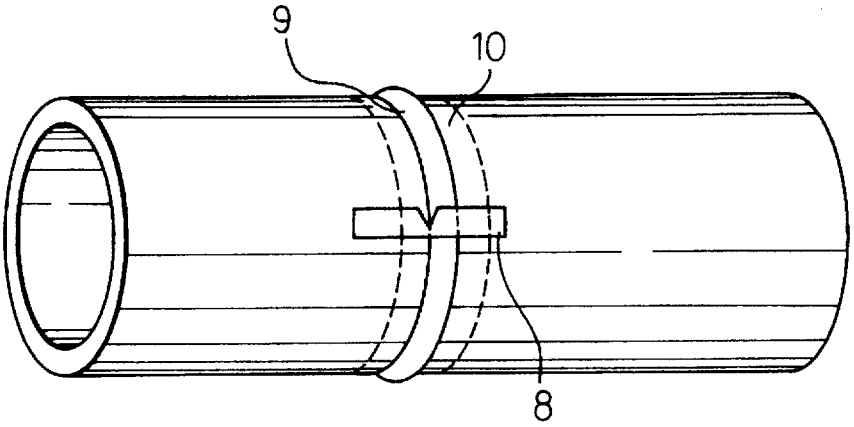
FIGS. 10(*a*) and 10(*b*) show a method of collecting a testpiece for a Charpy impact test from a steel pipe and a weld portion of a sheet material, respectively.
Figure 10B:
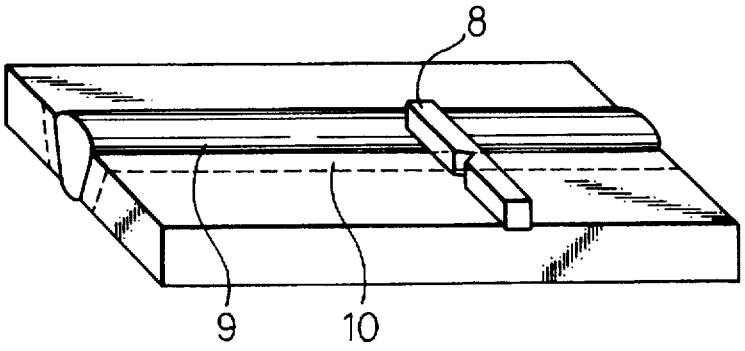

A JIS No. 4 notch Charpy testpiece 8 of 2 mm-V was cut out from the orthogonal direction to a weld line 9 from each steel pipe as shown in FIG. 10(*a*) or from each sheet material shown in FIG. 10(*b*), and the notch position was used as a weld bond 9 and was represented by the highest hardening portion. Its evaluation standard value was set to 50 J at 0° C. by assuming the assembly condition of the heat-resistant materials.

For comparison, those steels which did not correspond to the present invention in their chemical positions and those which did not correspond to the present invention in the production method were evaluated by a similar method. Among the chemical components and evaluation results, D-CRS, HAZCRS and M % are tabulated in Table 2. The relation between D-CRS and M % is already shown in FIG. 6.

Figure 11:
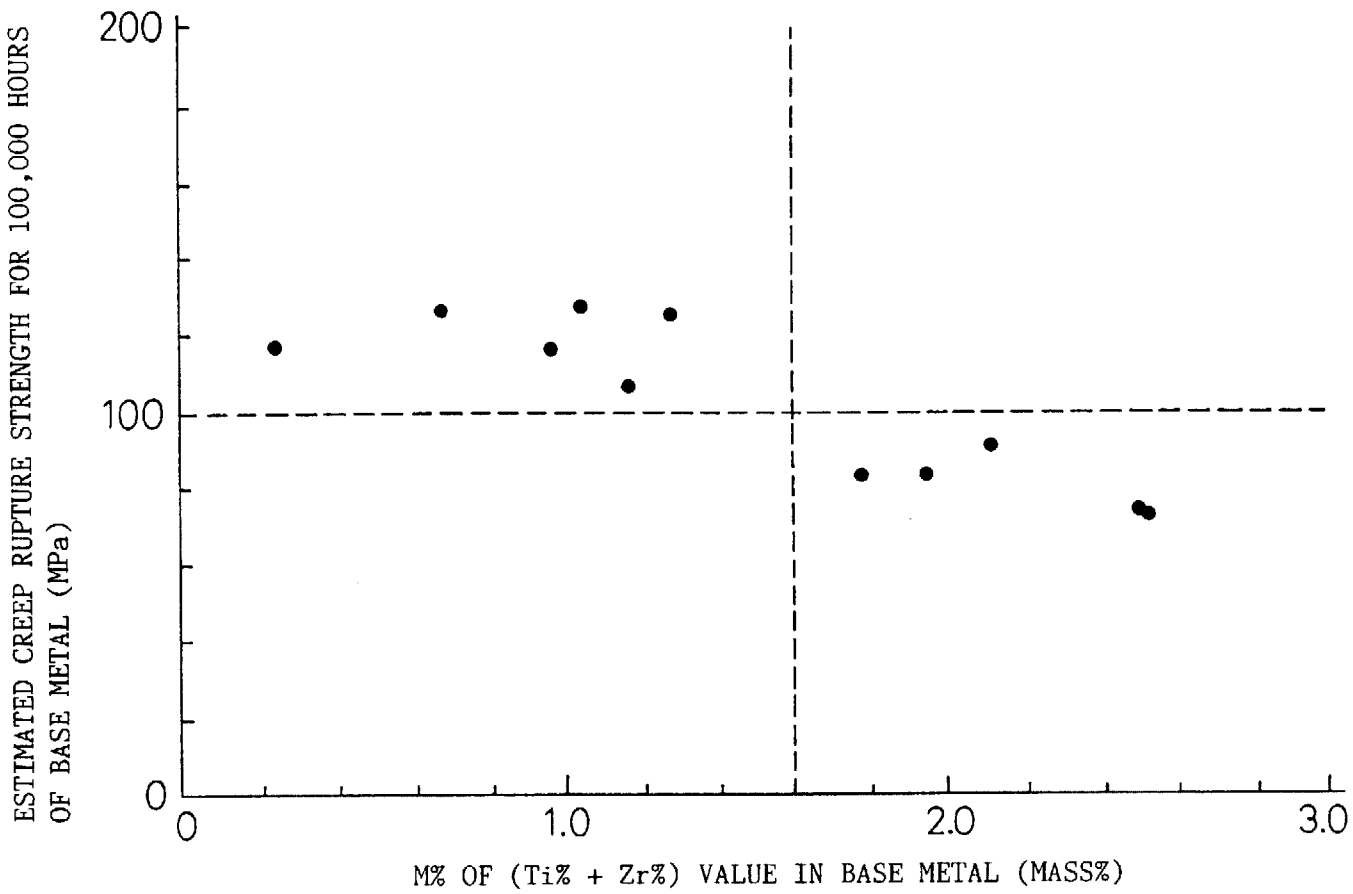
FIG. 11 is a diagram showing the relation between a linear extrapolation estimated creep rupture strength, at 600° C. for 100,000 hours, of a base metal and a (Ti %+Zr %) value in the base metal.

FIG. 11 is a diagram showing the relation between the creep rupture strength of the base metal and Ti %+Zr % in the base metal. The addition of the excessive amounts of Ti and Zr invited coarsening of the precipitates. As a result, the creep rupture strength of the base metal itself dropped, the impact value dropped next, and finally, both of them dropped.

Figure 12:
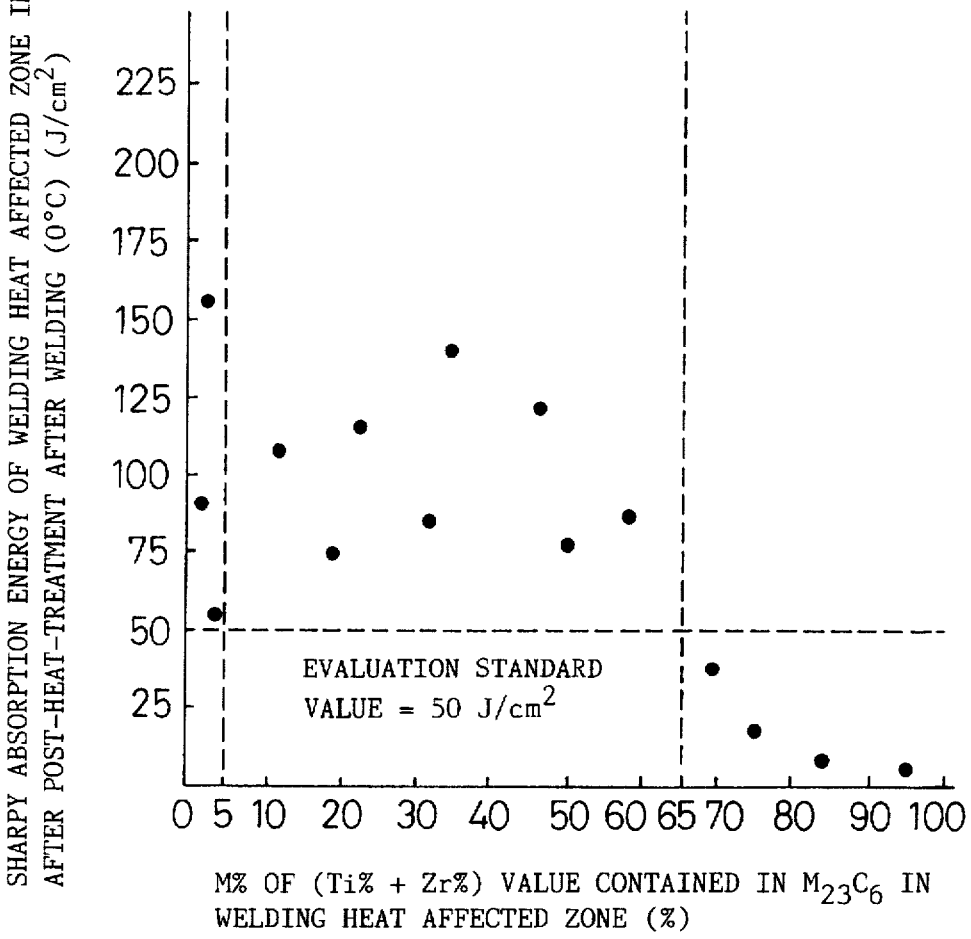
FIG. 12 is a diagram showing the relation between M % of a (Ti %+Zr %) value in a $M_{23}C_6$ type carbide of a welding heat affected zone and toughness of the weld portion.

FIG. 12 is a diagram showing the relation between the (Ti %+Zr %) value M % contained in $M_{23}C_6$ in the welding heat affected zone and the toughness of the welding heat affected zone. When the value M % exceeded 65, the precipitates became coarse and the drop of the toughness occurred. It could be thus understood that the evaluation value was lower than the standard value 50 J. The measurement values of D-CRS, HAZCRS and M % are typically tabulated in the form of numerical data in Tables 2 and 4.

Among the Comparative steels shown in Table 5, steel Nos. 76 and 77 represent the example where Ti and Zr were added from the time of melting, though the chemical components fell within the range of the present invention, and eventually, the M % value was less than 5 and the HAZ softening resistance characteristics were deteriorated. Steels Nos. 78 and 79 represent the example where the M % value dropped because both Ti and Zr were not sufficiently added, and the HAZ softening characteristics (D-CRS of at least 10 MPa) were deteriorated. In steels Nos. 80 and 81, the amount of addition of Ti was excessive in the No. 80 steel while the amount of addition of Zr was excessive in the No. 81 steel. Therefore, a large number of coarse carbides (TiC in the No. 80 steel and ZrC in the No. 81 steel) precipitated and the control of the $M_{23}C_6$ composition in the welding heat affected zone failed which resulted in deterioration of the HAZ softening resistance characteristics. Steel No. 83 represents the example where the retention time after temporary stop of cooling after the solid solution heat-treatment was excessively long, i.e. 240 minutes. Accordingly, the precipitates became coarse, the control of the $M_{23}C_6$ composition failed and the HAZ softening resistance characteristics deteriorated. Steel No. 84 represents the example where the amount of addition of W was not sufficient and the creep rupture strength of both the base metal and the weld portion dropped. Steel No. 85 represents the example where the amount of addition of W was excessive, so that large quantities of coarse intermetallic compounds precipitated in both the base metal and the joint, and the creep rupture strength eventually dropped. Steel No. 86 represents the example where the amounts of addition of both Nb and V were not sufficient, and the creep rupture strength dropped in both the base metal and the weld portion.

TABLE 6-continued

| No | D-CRS*1 (MPa) | HAZCRS*2 (MPa) | BASECRS*3 (Mpa) | M % | Ti, Zr addition timing |
|---|---|---|---|---|---|
| 80 | 24 | 100 | 124 | 0.6 | during steel making, 5 min. before tapping |
| 81 | 35 | 99 | 134 | 0.2 | during steel making, 5 min. before tapping |
| 82 | 38 | 81 | 119 | 1.6 | during steel making, 5 min. before tapping |
| 83 | 31 | 110 | 141 | 1.5 | during steel making, 5 min. before tapping |
| 84 | 3 | 56 | 59 | 42.6 | during steel making, 5 min. before tapping |
| 85 | 2 | 63 | 65 | 22.1 | during steel making, 5 min. before tapping |
| 86 | 5 | 42 | 47 | 31.3 | during steel making, 5 min. before tapping |

D-CRS*1: difference of estimated creep rupture strength by linear extrapolation at 550° C., for 100,000 hours, between base metal and weld portion (MPa)
HAZCRS*2: estimated creep rupture strength by linear extrapolation at 550° C., for 100,000 hours, of weld portion (MPa)
BASECRS*3: estimated creep rupture strength by linear extrapolation at 550° C., for 100,000 hours, of base metal (MPa)
M %: (Ti % + Zr %) value in M of $M_{23}C_6$ type carbide in welding heat affected portion (%)

INDUSTRIAL APPLICABILITY

The present invention makes it possible to provide a ferritic heat-resistant steel which has excellent HAZ softening resistance characteristics and exhibits a high creep strength at a high temperature of not lower than 500° C., and greatly contributes to the development of industry.

TABLE 5

| | (mass %) | | | | | | | | | | | | | | | |
|---|---|---|---|---|---|---|---|---|---|---|---|---|---|---|---|---|
| No | C | Si | Mn | Cr | Mo | W | V | Nb | N | Ti | Zr | Co | Ni | P | S | O |
| 76 | 0.085 | 0.321 | 0.414 | 1.26 | 0.56 | 1.56 | 0.056 | 0.066 | 0.044 | 0.008 | <0.001 | 3.21 | 2.05 | 0.016 | 0.0032 | 0.0156 |
| 77 | 0.091 | 0.303 | 0.500 | 1.24 | 0.58 | 1.50 | 0.067 | 0.064 | 0.045 | <0.001 | 0.007 | — | 0.26 | 0.023 | 0.0007 | 0.0124 |
| 78 | 0.077 | 0.305 | 0.501 | 1.20 | 0.54 | 1.24 | 0.201 | 0.042 | 0.040 | <0.001 | <0.001 | — | — | 0.011 | 0.0055 | 0.0008 |
| 79 | 0.061 | 0.305 | 0.505 | 1.25 | 0.53 | 1.80 | 0.210 | 0.085 | 0.039 | <0.001 | <0.001 | 4.05 | 1.17 | 0.009 | 0.0023 | 0.0153 |
| 80 | 0.085 | 0.315 | 0.552 | 1.24 | 1.05 | 1.81 | 0.211 | 0.232 | 0.038 | 0.964 | 0.223 | — | — | 0.008 | 0.0020 | 0.0122 |
| 81 | 0.084 | 0.225 | 0.606 | 1.24 | 1.00 | 2.52 | 0.205 | 0.310 | 0.042 | 0.151 | 1.164 | 2.06 | — | 0.009 | 0.0018 | 0.0136 |
| 82 | 0.093 | 0.161 | 0.499 | 2.26 | 1.09 | 2.24 | 0.233 | 0.026 | 0.035 | 0.156 | <0.001 | — | 3.16 | 0.023 | 0.0026 | 0.0051 |
| 83 | 0.245 | 0.351 | 0.487 | 2.45 | 0.89 | 2.87 | 0.501 | 0.099 | 0.075 | 0.557 | 0.068 | — | 0.29 | 0.015 | 0.0009 | 0.0061 |
| 84 | 0.166 | 0.055 | 0.503 | 2.28 | 0.87 | 0.008 | 0.582 | 0.414 | 0.035 | <0.001 | 0.054 | — | — | 0.010 | 0.0007 | 0.0126 |
| 85 | 0.187 | 0.056 | 0.506 | 2.20 | 0.53 | 6.48 | 0.274 | 0.401 | 0.076 | 0.563 | <0.001 | 0.56 | — | 0.009 | 0.0004 | 0.0015 |
| 86 | 0.215 | 0.084 | 0.445 | 3.10 | 0.87 | 1.00 | 0.006 | 0.003 | 0.029 | <0.001 | 0.033 | 0.28 | 0.23 | 0.009 | 0.0022 | 0.0018 |

TABLE 6

| No | D-CRS*1 (MPa) | HAZCRS*2 (MPa) | BASECRS*3 (Mpa) | M % | Ti, Zr addition timing |
|---|---|---|---|---|---|
| 76 | 28 | 95 | 121 | 2.1 | during melting |
| 77 | 28 | 103 | 131 | 3.0 | during melting |
| 78 | 32 | 106 | 138 | 4.1 | during steel making, 5 min. before tapping |
| 79 | 26 | 98 | 124 | 4.5 | during steel making, 5 min. before tapping |

We claim:

1. A ferritic heat-resistant steel having excellent HAZ softening resistance characteristics, comprising, in terms of mass %:

C: 0.01 to 0.30%,

Si: 0.02 to 0.80%,

Mn: 0.20 to 1.50%,

Cr: 0.50 to less than 5.00%,

Mo: 0.01 to 1.50%,

W: 0.01 to 3.50%,

V: 0.02 to 1.00%,

Nb: 0.01 to 0.50%,

N: 0.001 to 0.06%, one or both of the following members, either alone or in combination:

Ti: 0.001 to 0.8%, and Zr: 0.001 to 0.8%,

P: not more than 0.030%,

S: not more than 0.010%,

O: not more than 0.020%, and the balance consisting of Fe and unavoidable impurities; wherein an $M_{23}C_6$ type carbide has been precipitated by using Ti and Zr carbides as nuclei and then has been converted to a carbide consisting of $(Cr, Fe, Ti, Zr)_{23}C_6$ as the principal component by mutual solid solution, wherein the mass of (Ti+Zr) present in said (Cr, Fe, Ti, Zr) is from 5% to 65% of the total mass of said (Cr, Fe, Ti, Zr).

2. A ferritic heat-resistant steel having excellent HAZ softening resistance characteristics, comprising, in terms of mass %:

C: 0.01 to 0.30%,

Si: 0.02 to 0.80%,

Mn: 0.20 to 1.50%,

Cr: 0.50 to less than 5.00%,

Mo: 0.01 to 1.50%,

W: 0.01 to 3.50%,

V: 0.02 to 1.00%,

Nb: 0.01 to 0.50%,

N: 0.001 to 0.06%, one or both of the following members, either alone or in combination:

Ti: 0.001 to 0.8%, and

Zr: 0.001 to 0.8%, one or both of the following members:

Co: 0.2 to 5.0%, and

Ni: 0.2 to 5.0%;

P: not more than 0.030%,

S: not more than 0.010%,

O: not more than 0.020%, and the balance consisting of Fe and unavoidable impurities; wherein an $M_{23}C_6$ type carbide has been precipitated by using Ti and Zr carbides as nuclei and then has been converted to a carbide consisting of $(Cr, Fe, Ti, Zr)_{23}C_6$ as the principal component by mutual solid solution, wherein the mass of (Ti+Zr) present in said (Cr, Fe, Ti, Zr) is from 5% to 65% of the total mass of said (Cr, Fe, Ti, Zr).

3. A production method for a ferritic heat resisting steel having chemical components as defined in claim 1, said method comprising;

providing a melt of molten steel for producing said heat resistant steel;

adding said Ti and Zr to said melt, either alone or in combination, in said amounts of 0.001 to 0.8%, respectively, within 10 minutes before start of tapping of said melt;

tapping said melt and forming a steel slab by normal casting or forging;

solid solution heat treating of said slab;

cooling said solid solution heat treated slab and during said cooling of said solid solution heat treated slab, temporarily stopping cooling and holding said slab at 880° to 930° C. for 5 to 60 minutes.

4. A production method for a ferritic heat resisting steel having chemical components as defined in claim 2, said method comprising;

providing a melt of molten steel for producing said heat resistant steel;

adding said Ti and Zr to said melt, either alone or in combination, in said amounts of 0.001 to 0.8%, respectively, within 10 minutes before start of tapping of said melt;

tapping said melt and forming a steel slab by normal casting or forging;

solid solution heat treating of said slab;

cooling said solid solution heat treated slab and during said cooling of said solid solution heat treated slab, temporarily stopping cooling and holding said slab at 880° to 930° C. for 5 to 60 minutes.

* * * * *